United States Patent [19]

Ritchey et al.

[11] Patent Number: 4,559,782

[45] Date of Patent: Dec. 24, 1985

[54] TURBOCHARGER DRAIN LINE WITH REINFORCED FLEXIBLE CONDUIT

[75] Inventors: Stephen Ritchey, North Vernon; Jerry L. Kruse, Columbus, both of Ind.

[73] Assignee: Cummins Engine Company, Inc., Columbus, Ind.

[21] Appl. No.: 478,870

[22] Filed: Mar. 25, 1983

[51] Int. Cl.[4] ..... F02B 33/44

[52] U.S. Cl. ..... 60/605; 138/125; 138/126; 138/177

[58] Field of Search ..... 138/124, 125, 126, 130, 138/177, 137; 8/151; 139/426 R; 57/229; 523/212; 524/398; 60/605

[56] References Cited

U.S. PATENT DOCUMENTS

| | | | |
|---|---|---|---|
| 1,776,879 | 9/1930 | Baekeland | 138/126 X |
| 3,572,397 | 3/1971 | Austin | 57/229 X |
| 3,865,778 | 2/1975 | Christie | 524/506 X |
| 3,866,632 | 2/1975 | Schaffer | 138/130 |
| 4,144,632 | 3/1979 | Stroupe | 138/126 X |
| 4,181,157 | 1/1980 | De Camp | 138/126 |
| 4,259,989 | 4/1981 | Lalikos et al. | 138/126 X |
| 4,275,769 | 6/1981 | Cooke | 138/126 X |

*Primary Examiner*—James E. Bryant, III

*Attorney, Agent, or Firm*—Sixbey, Friedman & Leedom

[57] ABSTRACT

A flexible tubular conduit for fluid flow therethrough, particularly adapted to form a portion of a drain line for returning lubricating oil from a turbocharger housing to the engine lubricating system of an internal combustion engine on which the turbocharger is used, the conduit comprising an integral tubular wall having inner and outer adhered coaxial layers, the inner layer defining the inner wall surface in contact with the fluid flowing therethrough and formed of a used lubricating oil resistant silicone rubber and the outer layer comprising at least one and, preferably, at least four adhered, coaxial lamina formed of woven aromatic polyamide, reinforcing fabric, such as Nomex, coated with a high modulus, high strength silicone rubber.

4 Claims, 2 Drawing Figures

TURBOCHARGER DRAIN LINE WITH REINFORCED FLEXIBLE CONDUIT

TECHNICAL FIELD

The present invention relates to reinforced flexible conduits and, more particularly, to conduits adapted for conveying high temperature, contaminant-containing petroleum products.

BACKGROUND ART

Turbochargers are commonly used today on internal combustion engines for supercharging diesel and gasoline engines such as are used in motor vehicles, farm tractors, and the like. The bearing surfaces of these turbochargers are lubricated by oil fed under pressure from the lubrication system of the internal combustion engine on which the turbocharger is being used into one or more lubricating oil passages in the turbocharger housing and, then, to the various bearing surfaces in need of lubrication. The lubricating oil returns from the turbocharger to the internal combustion engine lubricating system via a drain or oil return line connected by appropriate fittings between the turbocharger housing and the engine block. Typically the drain line is formed of stainless steel or other suitable metal and includes a flexible, elastomeric section for correcting or preventing misalignment problems between the turbocharger housing and the engine block.

Conventionally, the drain line flexible section is formed of rubber or other well known, commonly available flexible, hydraulic-type hose material. However, the used lubricating oil returning to the engine block is relatively hot, about 300°–325° F., and contains contaminants, such as combustion products, metal particles, dirt, water, and the like, which create a very severe environment for the hose material. Experience has shown that flexible, hydraulic type hose materials commonly in use degrade rapidly in this environment leading to oil leakage problems. As a result, the flexible hose section of the drain line must be replaced on a hot-infrequent basis which is inconvenient, costly, time consuming and reduces the reliability of the vehicle in which the turbocharged engine is installed.

It is, therefore, the purpose of the present invention to overcome previously encountered problems and to provide a simple, efficient and low cost reinforced flexible conduit which is capable of conveying high temperature, contaminated lubricating oil without degrading or deteriorating, and is therefore suitable for use in applications such as turbocharger lubricating oil drain or return lines.

DISCLOSURE OF THE INVENTION

In one aspect of the present invention this is accomplished by providing a flexible tubular conduit for fluid flow therethrough comprising an integral tubular wall having two adhered coaxial layers, the inner layer defining the inner wall surface of said conduit in contact with the fluid flowing therethrough and formed of a used lubricating oil resistant silicone polymer and the outer layer comprising at least one lamina formed of woven reinforcing cloth coated with a tough, heat resistant siloxane copolymer.

In another aspect of the present invention the outer layer comprises a plurality of adhered coaxial lamina, each lamina comprising woven reinforcing cloth coated with a tough, heat resistant siloxane copolymer.

In still another aspect of the present invention there is provided in a turbocharger drain line interconnecting a turbocharger housing and the block of an internal combustion engine on which the turbocharger is used, the drain line adapted for returning lubricating oil from the turbocharger to the engine lubricating system, a flexible tubular conduit forming a portion of said drain line, said conduit comprising an integral tubular wall having two adhered coaxial layers, the inner layer defining the inner wall surface of said conduit in contact with the fluid flowing therethrough and formed of a used lubricating oil resistant silicone polymer and the outer layer comprising at least one lamina formed of woven reinforcing cloth coated with a tough, heat resistant siloxane copolymer.

BRIEF DESCRIPTION OF THE DRAWINGS

The invention will be better understood from the following description taken in conjunction with the accompanying drawings, in which.

BEST MODE FOR CARRYING OUT THE INVENTION

Figure 2:
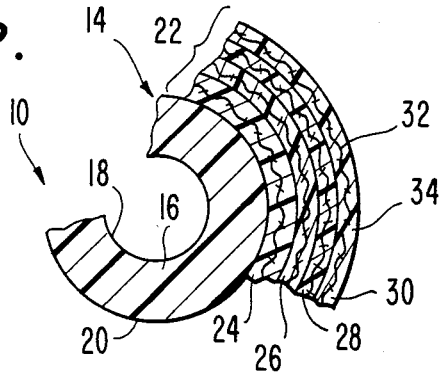
FIG. 2 is a sectional view taken substantially along line 2—2 in FIG. 1.

Referring first to FIG. 2 for the details of configuration and construction of conduit 10 of the present invention it can be seen that conduit 10 is a generally hollow cylindrical body of tubular configuration formed of a plurality of laminations or layers bonded together by any suitable and conventional method into a self-supporting integral structure of generally circular cross-sectional form. Conduit 10 comprises an integral tubular wall 14 having an inner tubular layer 16 formed of a used lubricating oil resistant, cured, heat vulcanizable silicone rubber elastomer defining within its inner wall surface 18 the flow space for the lubricating oil. Adhered to its outer wall surface 20 for forming integral wall 14 is outer tubular layer 22 which, depending upon its intended usage, may comprise from one to a plurality of adhered, coaxial tubular lamina 24, 26, 28, 30. Each of the lamina 24, 26, 28, 30 comprises an aromatic polyamide fabric 32 coated on at least one face with a tough, heat resistant silicone polymer 34. As will be more readily understood from the description that follows the outer layer 22 of integral wall 14, comprising adhered coaxial layers or lamina, is formed by wrapping each lamina 24, 26, 28, 30 sequentially onto the radially inwardly adjacent lamina 24, 26, 28 or layer 16 with the silicone polymer coated face of the fabric in contact with the inwardly adjacent lamina or layer. The wrapping pressure causes a portion of the silicone polymer coating on the fabric to strike through the fabric openings for adhering the fabric to the radially inwardly and any outwardly adjacent layers or lamina.

In a preferred embodiment of the present invention, inner tubular layer 16 is a used lubricating oil resistant silicone rubber having high resistance to lubricating oil deterioration and low compression set. Desirably, layer 16 is just thick enough to be readily fabricated and to perform its function of conveying hot, used lubricating oil, about 0.040 inches thick or less. The presently preferred material for inner layer 16 is a filler-containing heat vulcanizable silicone rubber composition having a specific gravity in the cured state of 1.2 to 1.7 and comprising organopolysiloxane polymers and blends thereof having a viscosity of 1,000,000 to 200,000,000 centipoise at 25° C. and having the formula $(R)_aSiO_{(4-a/2)}$ and a curing catalyst, e.g., an organic peroxide catalyst. Such a silicone rubber composition is more fully disclosed in U.S. Pat. No. 3,865,778, the disclosure of which is incorporated herein by reference. Such a material is available commercially as General Electric SE3724U silicone rubber compound. This rubber has a red color, a specific gravity of 1.29±0.03, a polymer classification (ASTM 1418-71) of VMQ and is adaptable to fabrication by such techniques as compression, transfer and injection molding. It is desirably cured using dicumyl peroxide, 40% active, available commercially from Hercules Powder Co. as DiCup 40C or 2,5, dimethyl-2,5 di(t-butylperoxy)hexane, 50% active, available commercially from R. T. Vanderbilt Co. as Varox. Based upon a 0.075 inch thick compression molded slab press cured with 0.9 parts Varox/100 parts silicone rubber compound for 10 minutes at 350° F. and post cured for four hours at 480° F., this type of silicone rubber has a Shore A Durometer of 70±5 (ASTM D-2240), a tensile strength of 1000 psi (ASTM D-412), an elongation modulus of 140% (ASTM D-412), a tear strength Die B of 65 pounds/inch (ppi) (ASTM D-624), a brittle point of −100° F. (ASTM D-746) and a linear shrinkage of 4.1%. The unique resistance to degradation by used engine oil of this silicone rubber compound is demonstrable by immersing a sample in used engine lubricating oil for 168 hours at 302° F. Following the immersion test the compound had a Shore A Durometer of about 62, a tensile strength of about 930 psi, a 10% reduced elongation modulus and an 11.5% increased volume. When slabs of the engine oil immersed elastomer and O-rings formed therefrom were subjected to a load compressing it 25 percent by volume at temperatures of 300 to 350° for 70 hours, the compression set was very low, i.e., less than the 60% level generally considered acceptable.

Outer layer 22 comprises one or more plies or lamina, each ply or lamina being formed of an aromatic polyamide fabric coated on at least one face with a dough, heat resistant siloxane copolymer. Desirably, each ply or lamina is about 0.01 to 0.02 inches thick. The preferred fabric is Nomex fabric, HT-6, available from the E. I. duPont de Nemours Company. It is generally preferred that the aromatic polyamide fabric be 45×45 count, plain weave, 0.006 inches thick and weighing 2.4 ounces/yard. Nomex fibers are well known to have outstanding high temperature resistance and extremely low flammability. Accordingly, they have generally been selected for use in applications requiring their heat and flame resistant qualities. See, for example, U.S. Pat. No. 3,572,397. Nomex fibers have also been used to provide a low density reinforcement for natural, styrene/butadiene copolymer, polychloroprene and nitrile rubbers, as disclosed in U.S. Pat. No. 4,408,362. Chemically, Nomex is poly(m-phenylene terephthalamide) and is believed to be formed by the copolymerization of metaphenylenediamine and isophthaloyl chloride.

The heat resistant siloxane copolymer coating applied onto the Nomex, for example by a conventional calendering process, in the formation of the plies of outer layer 22 is preferably Dow Corning Silastic TR-55 silicone rubber which has a polymer classification of VMQ(ASTM D 1418) and exhibits very high tear strength and high modulus, good nick and abrasion resistance, good flex-life and hot tear strength, making it particularly suitable for the outer layer of a clamped tubular conduit. This physically tough rubber may be prepared with any number of commercially available vulcanizing agents, for example Varox available from R. T. Vanderbilt Co., Inc. (2,5 dimethyl-2,5 di(t-butylperoxy)hexane), Cadox TS-50 available from Noury Chemical Co. (2,4-dichlorobenzoyl peroxide), Lupersol 101 available from Lucidol Division, Penwalt Corp., and Di-Cup R available from Hercules, Inc. (dicumyl peroxide). The properties exhibited by the resulting rubber vary depending upon the vulcanizing agent used. However, based upon a 0.075 inch thick slab press cured with Varox for 10 minutes at 171° C. (340° F.) typical properties of this silicone rubber are a specific gravity of 1.15, a brittle point of −73° C. (−100° F.), a Shore A-2 Durometer Hardness of 55, a tensile strength of 1350 psi, an elongation of 900%, a tear strength Die B of 300 pounds/inch (ppi), an elongation modulus of 250%, a compression set of 47 after 22 hours at 177° C. (350° F.) and a linear shrinkage of 3.4%. Following heat aging for 24 hours at 225° C. (438° F.) the silicone rubber exhibited a ten percent increased Durometer Hardness, a twenty percent increased tensile strength and a thirty eight percent increased elongation.

As an initial step in the manufacture of a typical conduit 10, for use as a section of a lubricating oil drain line, a 0.04 inch layer of used lubricating oil resistant silicone rubber, such as General Electric SE 3724U, is wound on a mandrel to form inner flow tube 16. A coating of tough, heat resistant silicone rubber, such as Dow Corning Silastic TR-55, is calendered onto one face of an aromatic polyamide fabric, such as Nomex HT-6, and cut into appropriate lengths such that each length represents a single lamina or ply having a ply thickness of 0.020 inch. A coated Nomex strip is wrapped onto the outer surface 20 of inner layer 16 with the silicone rubber coating 34 in contact with the surface 20, i.e., with the reinforcing Nomex fabric 32 on the outside of the ply, to form a first lamina 24 of outer layer 22. Wrapping pressure causes a portion of the coating 34 to strike through the openings in the fabric weave with the result that the wrapped ply has some silicone rubber on each face of the reinforcing fabric. Additional coated Nomex strips, comprising lamina 26, 28, 30, etc., as required to make up outer layer 22, are individually wrapped onto the outer surface of the preceding lamina with the silicone rubber coating 34 in contact with the outer surface. In each case the wrapping pressure causes a portion of the coating 34 to strike through the openings in the fabric weave which facilitates silicone rubber to silicone rubber bonding for adhering the layers. The outermost lamina or ply 30 has reinforcing Nomex fabric as its outside surface with some silicone rubber strike through on the exposed fabric surface. It is preferred for uses such as drain line sections that outer layer 22 have not less than four plies or lamina to provide sufficient rigidity to avoid kinking of the conduit while, at the same time, to be sufficiently durable to withstand cutting by the hose clamps which secure it within the drain line as can be seen more clearly with reference to FIG. 1. A nylon wrap is applied on outer lamina 30 for precure and the mandrel and lamina wrapped thereon are placed in an oven and pre-cured for 30 minutes at 350°

F. Next, the nylon wrap is removed and the partially cured or pre-cured conduit is cooled and removed from the mandrel. The conduit is next subjected to a post-cure at 350° F. for several hours.

INDUSTRIAL APPLICABILITY

Figure 1:
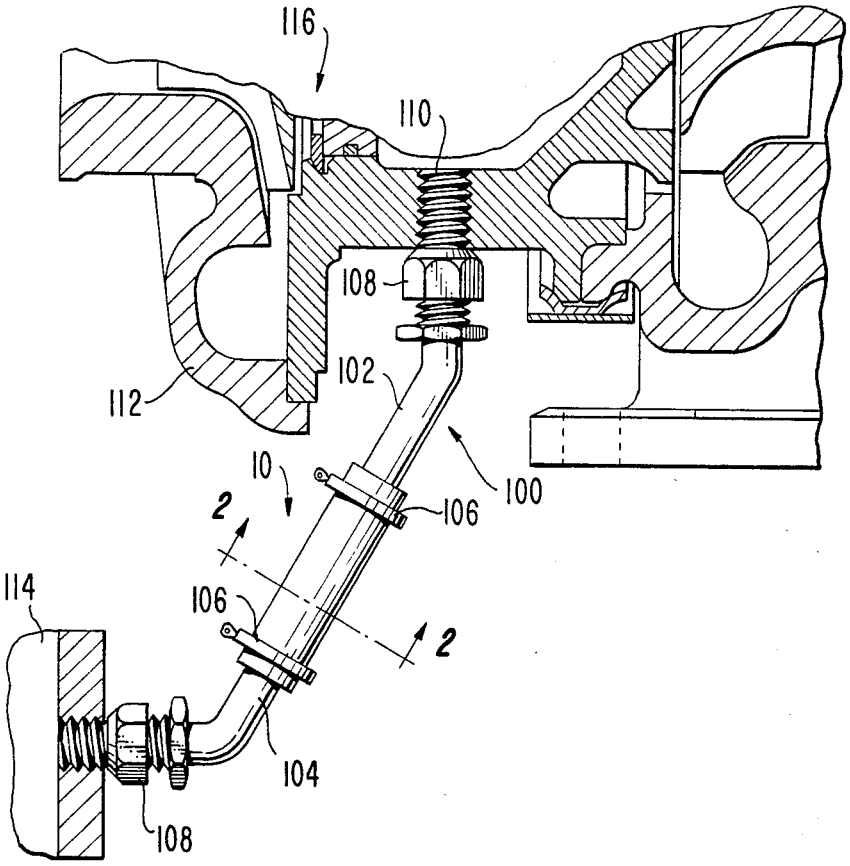
FIG. 1 is a view, partially in section, with portions broken away and elements repositioned for purposes of clarity, of a turbocharger housing and an internal combustion engine block interconnected by a lubricating oil drain line, including as a portion thereof the reinforced flexible conduit of the present invention.

The resulting conduit, manufactured in accordance with the foregoing procedure from the preferred materials, will be suitable for use under conditions of temperature and wear normally experienced in internal combustion engines, and is especially suitable for conveying used lubricating oil. The reinforced, flexible tubular conduit 10 of the present invention is particularly useful when employed as a section of a lubricating oil drain line 100, as shown in FIG. 1, which consists of drain line sections 102, 104 formed of stainless steel or other suitable metal secured to opposite end portions of conduit 10 with conventional band or wire-type hose clamps 106. End fittings or adapters 108 at the ends of drain line sections 102, 104 engage lubricating oil return 110 of turbocharger housing 112 and engine block 114 for interconnecting turbocharger 116 and engine block 114 (the relative orientation of which have been altered in FIG. 1 for purposes of clarity) via drain line 100. In this manner lubricating oil from the engine lubricating system supplied under pressure to turbocharger 116 for lubricating the bearing thereof may return to the oil pan of the engine lubricating system. The flexibility of conduit 10 accounts for any misalignment in the mounting of the turbocharger on the engine block and prevents stressing the drain line in the event of relative movement between the turbocharger and engine block.

We claim:

1. In a turbocharger drain line interconnecting a turbocharger housing and the block of an internal combustion engine on which the turbocharger is used, the drain line adapted for returning lubricating oil from the turbocharger to the engine lubricating system, a flexible tubular conduit forming a portion of said drain line, said conduit comprising an integral tubular wall having inner and outer adhered, coaxial layers, said inner layer defining the conduit inner wall surface in contact with the fluid flowing therethrough and formed of a used lubricating oil resistant silicone rubber and said outer layer comprising at least one lamina formed of woven aromatic polyamide reinforcing fabric coated with a high modulus, high tear strength silicone rubber, said used lubricating oil resistant silicone rubber comprising a filled, heat vulcanizable silicone rubber composition including organopolysiloxane polymers and blends thereof having a viscosity of 1,000,000 to 200,000,000 centipoise at 25° C. and a curing catalyst, said rubber having a specific gravity in the cured state of 1.20 to 1.70, said high modulus, high tear strength silicone rubber having a Shore A-2 Durometer Hardness of 55, a tensile strength of 1350 psi, an elongation modulus of 250%, and a Die B tear strength of 300 ppi based upon a 0.075-inch-thick slab press cured for 10 minutes at about 171° C., said inner layer having a thickness up to about 0.04 inches, said outer layer comprising at least four adhered, coaxial lamina and each lamina having a thickness of 0.01 to 0.02 inches.

2. A turbocharger drain line, as claimed in claim 1, wherein said aromatic polyamide is poly (m-phenyleneterephthalamide).

3. A turbocharger drain line, as claimed in claim 1, wherein said fabric has a 45×45 count and a thickness of about 0.006 inches.

4. A turbocharger drain line, as claimed in claim 1, wherein said used lubricating oil resistant silicone rubber has a Shore A durometer Hardness of 70±5, a tensile strength of 1000 psi, an elongation modulus of 140% and a Die B tear strength of 65 ppi based upon a 0.075 inch thick slab press cured for 10 minutes at 350° C.

* * * * *